US005136142A

United States Patent [19]

Logan

[11] Patent Number: 5,136,142

[45] Date of Patent: Aug. 4, 1992

[54] RETRACTABLE BURNER FOR AN ELECTRIC RANGE HAVING A REMOVABLE BURNER ELEMENT

[76] Inventor: Eugene T. Logan, 449 Queens Rd., Salina, Kans. 67401

[21] Appl. No.: 785,096

[22] Filed: Oct. 29, 1991

Related U.S. Application Data

[63] Continuation-in-part of Ser. No. 641,461, Jan. 15, 1991, Pat. No. 5,084,608.

[51] Int. Cl.[5] ..... H05B 3/76

[52] U.S. Cl. ..... 219/461; 219/459; 219/444; 219/456

[58] Field of Search ..... 219/459, 461, 444, 456, 219/458, 463, 467, 451, 457, 464

[56] References Cited

U.S. PATENT DOCUMENTS

| | | | |
|---|---|---|---|
| 1,399,696 | 12/1921 | De Roo | 219/418 |
| 1,825,406 | 9/1931 | Lipman | 219/418 |
| 2,528,579 | 11/1950 | Clark | 219/418 |
| 2,635,172 | 4/1953 | Rutenber | 219/418 |
| 2,664,495 | 12/1953 | Wehrli | 219/418 |
| 2,761,053 | 8/1956 | Schneider | 219/392 |
| 2,825,790 | 3/1958 | Sims | 219/418 |
| 3,440,406 | 4/1969 | Sego | 219/444 |
| 3,578,951 | 5/1971 | Ingrao | 219/444 |
| 3,700,856 | 10/1972 | Kullman | 219/451 |
| 3,898,430 | 8/1975 | Sego | 219/444 |
| 4,206,341 | 6/1980 | Leuschner | 219/462 |

*Primary Examiner*—Teresa J. Walberg
*Attorney, Agent, or Firm*—Head & Johnson

[57] ABSTRACT

In a device for raising and lowering a burner element of an electric range, cookware is supported upon a plurality of rigid posts and the burner element is raised and lowered in a plane parallel to the plane of the bottom surface of the cookware. This allows the user to obtain radiant heat transfer for more even cooking. In addition, lowering the burner allows the cookware to cool quickly without removing it from the range, unlike traditional electric ranges where the cookware rests directly upon the burner element and must be removed from the range to cool.

15 Claims, 5 Drawing Sheets

RETRACTABLE BURNER FOR AN ELECTRIC RANGE HAVING A REMOVABLE BURNER ELEMENT

RELATED APPLICATIONS

This application is a continuation-in-part of copending application, Ser. No. 07/641,461, filed Jan. 15, 1991, now U.S. Pat. No. 5,084,608, which is incorporated by reference hereto.

BACKGROUND OF THE INVENTION

1. FIELD OF THE INVENTION

This invention relates to an apparatus for use in an electric range.

2. DESCRIPTION OF THE RELATED ART

The disadvantage of cooking with a traditional electric range is that the cookware rests directly upon the burner element. As a result, the coil-type element itself must include a relatively thick metal sheath of thickness and strength to support the cookware without deforming the element. In this type of range, the heat source cools much slower than other types, such as gas. The electric burner element transfers heat to the cookware in the electric range, while it is the flame produced by the burning of the natural gas or propane that transfers heat in the gas range. When the electric burner is turned off, heat is still transferred to the cookware because the hot burner element and the cookware are in direct contact. This heat transfer continues until the burner element cools to room temperature. When the gas range is turned off or with less flame, the gas flow ceases and the flame is extinguished. The heat transfer ceases at the point of shutoff, and the cookware begins to cool immediately. If the desired result is to lower the intensity of the heat transfer, the user of the electric range has to take into account time required for the burner element to cool to the new temperature setting. With the gas range, decreasing the gas flow lowers the intensity of the flame, thereby immediately decreasing the heat transferred. The ability to rapidly vary the amount of heat transferred has been the major advantage of gas ranges over electric. The present invention gives the electric range this same versatility.

The following U.S. Patents are believed pertinent:

| | | |
|---|---|---|
| 1,399,696 | 12/06/1921 | C. P. De Roo |
| 1,825,406 | 09/29/1931 | Lipham |
| 2,528,579 | 11/07/1950 | E. K. Clark |
| 2,635,172 | 04/14/1953 | E. A. Rutenber |
| 2,664,495 | 12/29/1953 | A. Wehrli |
| 2,761,053 | 08/28/1956 | F. H. Schneider |
| 2,825,790 | 03/04/1958 | R. J. Sims |
| 3,440,406 | 04/22/69 | Sego, Jr. |
| 3,700,856 | 10/24/72 | Kullman |
| 3,578,951 | 05/18/71 | Ingrao |
| 3,898,430 | 08/05/75 | Sego et al |
| 4,206,341 | 06/13/1980 | Leuschner et al |

Many of these patents were directed to deep well devices wherein the lower heating element could move up and down but would always maintain contact with the cookware. This is the case in the patents of Wehli, Lipman, and Schneider.

The patents of Sims, Rutenber, and Clark relate to devices in which the heating element can be moved from a lower position to an upper position for use either as a respectively deep well cooker or a regular top heating element. However, the cookware maintains constant direct contact with the heating element in these devices also.

The De Roo patent discloses an electric heater device used in an apparatus for determining the amount of moisture in a product which heats a receptacle containing the product to be tested. The electric heater device is immediately released and automatically moved away from the receptacle when the heat rises above a predetermined degree, thus ceasing heat transfer.

The Leuschner et al patent discloses a warming plate wherein the heating element can be pivoted about a point such that the element makes an arcuate motion about a fixed point up to and away from the surface of the warming plate.

In Kullman the heating element and all of the utensil support members are locked together with the trim ring, all of which are pivotally connected to the stove. The heating element is pivoted relative to the pan, i.e., it does not raise and lower axially vertically.

Ingrao is a vertically movable heating element using a complex linkage, diversion baffling, splash pans, etc. to prevent food spillage from contacting the linkage.

Sego et al '430 provides a vertically movable hot plate level adjuster which is held together by a center threaded nut. Solenoid actuated mechanisms raise and lower the heating element via rotation of a circular cam and follower mechanism.

Sego Jr. '406 shows an early form of hot plate level adjuster using an electromagnet.

SUMMARY OF THE INVENTION

This invention relates to an apparatus for an electric range which allows the user to raise and lower the burner element independently of the cookware that is being heated by that burner element. In this invention, the cookware rests on top of a plurality of support posts instead of the burner element itself. The support posts are fixed to the range and stay at a fixed level while the burner element can be raised and lowered with respect to the top of the support posts. In the preferred embodiment, a control knob is connected to a series of actuating arms which operate to raise and lower a spring tensioned spool. Support means for the burner element is fixed to this spool; thus, the burner element is raised and lowered in a plane parallel to the plane of the bottom surface of the cookware by the raising and lowering of the spool. Various combinations of heating modes can be obtained because the burner element can be in the raised or lowered position at any heat setting. When in the lower position it provides gentle heat (radiant only), while in the raised position it provides the traditional direct heating.

The present invention can be used with the traditional electric range to provide substantially the same effect as the rapid cooling characteristic of a gas range. Uniformly supporting the cookware above a lowered electric burner element in a parallel plane reduces heat transfer to the bottom surface of the cookware. While in such position, the heat element provides gentle heat (radiant) which is useful for simmering foods such as puddings, sauces, gravies, or soups. Any combination of heating modes can be obtained where the burner element can be raised or lowered at any heat setting.

The object of the invention is to maintain consistent uniform heating of the cookware while being able to remove the electric burner element from direct contact with the cookware.

A further object of the invention results in an electric heating element having a thinner metal sheath than that of the prior art since it is not necessary for the element to support the cookware.

A further object of the invention is to provide an electric burner element capable of vertical adjustment as set forth in the prior copending application, Ser. No. 07/641,461, and having a pivotal electrical connection that permits assembly and convenient unplugging and removal of the burner element for disassembly and cleaning of the apparatus of this invention and the reflective bowl therebeneath.

A further object of the invention is to provide a convenient means to disassemble the components that make up the retractable burner element assembly.

BRIEF DESCRIPTION

DETAILED DESCRIPTION OF THE PREFERRED EMBODIMENT

Before explaining the present invention in detail, it is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein is for the purpose of description and not of limitation.

Figure 1:
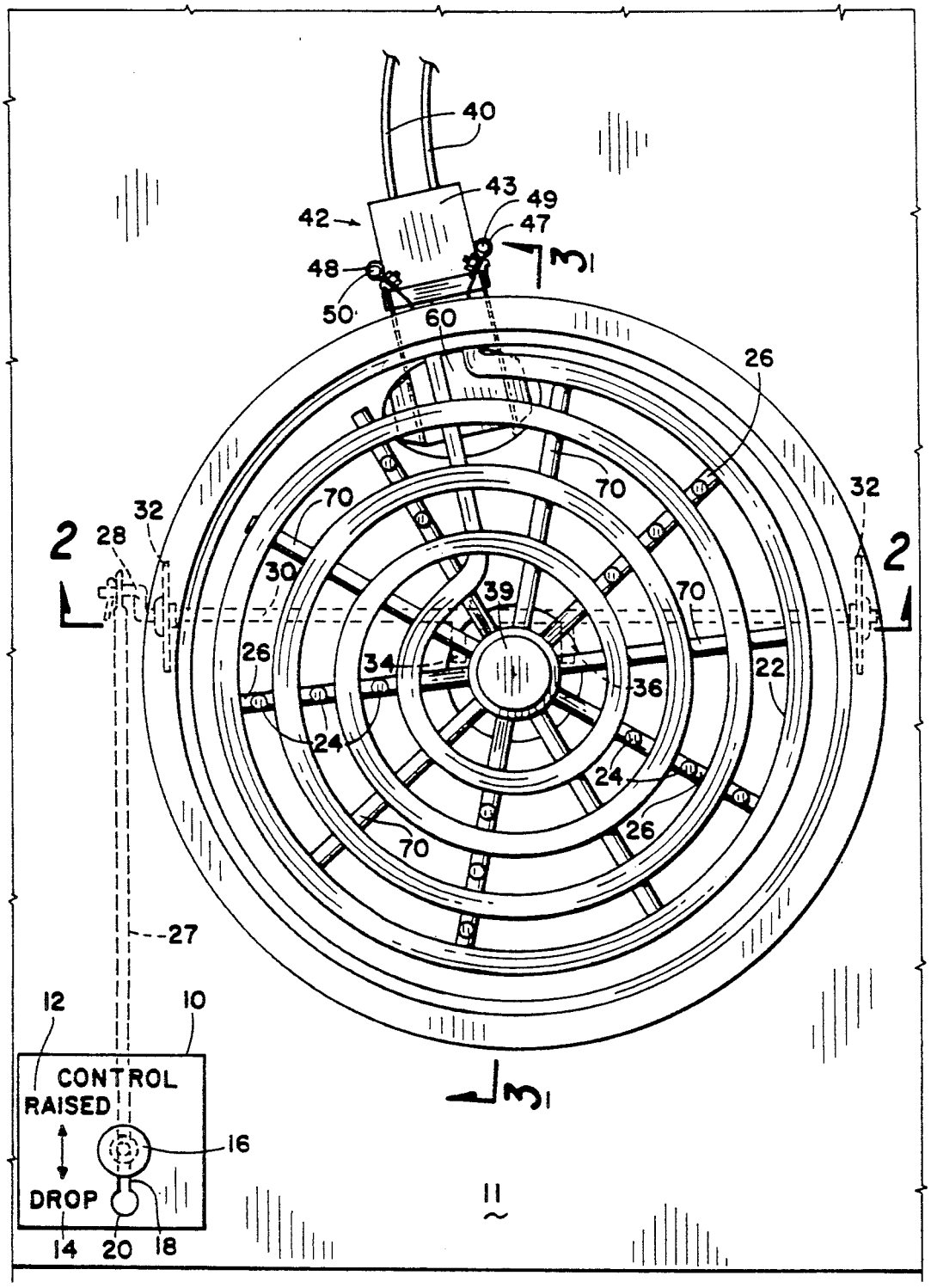
FIG. 1 is a top elevated view of the heating elements of the invention.
Figure 2:
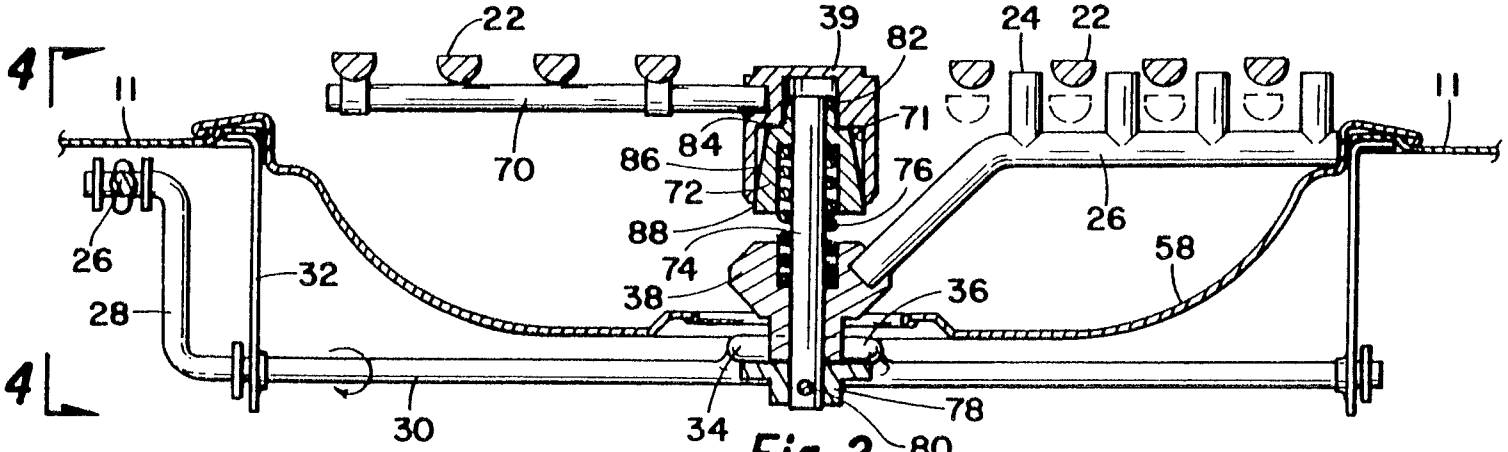
FIG. 2 is a view taken along line 2—2 of FIG. 1 showing the burner element in the raised position.

Reference is first made to FIG. 1 which shows one form of a burner height control panel 10 attached to the stove top 11 having two settings—a raised setting 12 and a lower or drop setting 14. The user can position a knob 16 to the raised position 12 by sliding it forward in a channel opening 18 or sliding it back and securely engaging it into keyhole-like opening 20 of control panel 10 for the lower or drop position. As shown in FIG. 2, with knob 16 in the raised position 12, burner element 22 is at the level of the top of support posts 24 on radial support arms 26. As shown in FIG. 2 by the dotted lines, when knob 16 is in the drop position 14, the burner element 22 is well below the top of posts 24, and the cookware, not shown, will rest upon the posts 24.

With continued reference to FIG. 1, a first actuating arm 27 is connected at one end to knob 16 and pivotally connected to a second actuating arm 28 at its other end. Arm 28 is composed of three segments, a long middle section and two shorter segments which are at right angles to the long section. One of the shorter segments is connected to the first actuating arm 27 and the other is connected to rod 30. The second actuating arm 28 is rigidly attached to rod 30 which extends underneath the burner assembly. Rod 30 is secured to the range on opposite sides of the burner assembly by two supports, each labeled 32, in which rod 30 is free to rotate. A third actuating arm 34 and a fourth actuating arm 36 extend at 90 degrees to rod 30 and are rigidly attached to it. Actuating arms 34 and 36 are pivotally connected to spool 38 at points 180 degrees spaced around the circumference of spool 38 to effect the raising and lowering of the burner element 24. The burner element 24 is comprised of a single circular coil having a space between each coil. The coiled burner element 22 of this invention is removably connected to a suitable electrical power source 40 via a plug assembly generally designated by the numeral 42.

Figure 3:
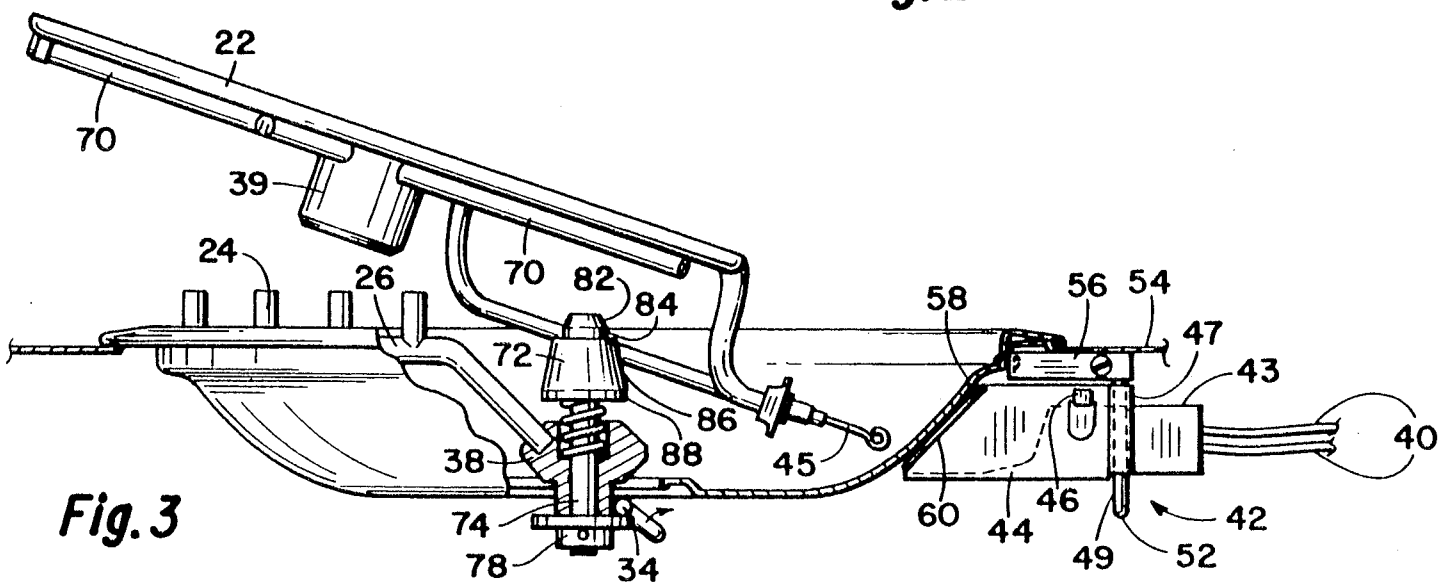
FIG. 3 is a view taken along line 3—3 of FIG. 1 showing the burner element being removed.

Referring both to FIGS. 1 and 3, the plug assembly comprises female plug 43 attached to retainer 44 to receivably guide the burner element 22 male plug 45 for connecting and disconnecting the burner element 22. Keeper 46 retains the plug 43 and the retainer 44 in the assembled condition as shown. The retainer includes spaced circular guides 47 and 48 which vertically ride on the vertical rods 49 and 50 of a U-shaped member, the lower bight portion 52, which acts as a stop, not shown. The U-shaped member is retained to the stove top 54 by bracket 56. The retainer includes a wide mouth 60 with at least vertical sides to guide the male plug 45 during connection with female plug 43. In some instances it is preferable that there be no bottom to the retainer in that area below the cooking surface, or other means, to prevent collection of spills. Once connected, the plug assembly will freely move vertically for various height settings of the burner element 22.

The burner assembly comprises the burner element 22 which is connected to, in this instance, five radial support arms 70, which are rigidly connected to central hub 39. Actuating knob 16 actuates arms 27, 28, 34, 36, and rod 30 which causes (via the assembly shown in FIG. 2) a central hub 39, connected radial arms 70, and connected burner element 22 to be raised or dropped. Although two positions are shown, it should be understood that the burner element can be positioned intermediate thereto.

Figure 7:
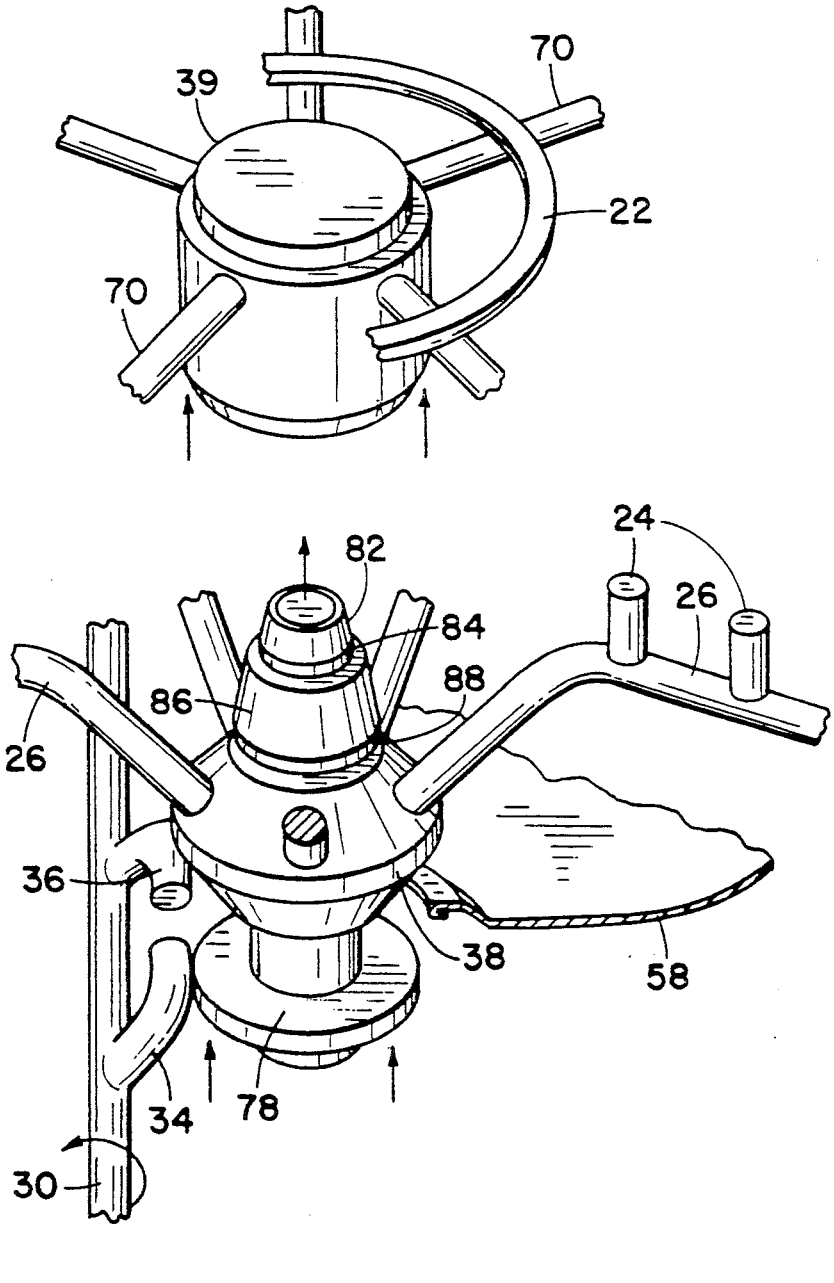
FIG. 7 is an exploded view depicting the removable disassembly of the burner part of this invention.

In FIG. 2 the burner assembly is shown with the burner element in the raised position against the bottom surface of and supporting the cookware while the dotted lines show the lower/drop position. The central hub 39 includes a central opening 71 to receive cone 72 formed as a part of the assembly, including vertical post 74, spring 76, and a follower on keeper 78. The latter is attached to the post 74 by pin 80. To provide not only a rigid connection between hub 39 and cone 72 but also easy removability of the burner element 22 and radial arms 70, one form of connection is described. See also FIGS. 3 and 7. The cone 72 includes a beveled tip 82 and a first slightly tapered conical seating surface 84, a second conical seating surface 86, and a less tapered or cylindrical surface 88.

Referring to FIGS. 2 and 3, the use and operation of the invention is described. During cooking, the heating element 22 and attached radial arms 70 are, in this embodiment, normally biased to the raised position against the cookware. To lower the element, rod 30 is rotated as shown which draws keeper 78, shaft 74, and cone 72 downward against spring 76, where it is held until released.

To clean the burner assembly, the heating element is placed in the lowered position. The heating element 22 and connected radial arms 70 are lifted above cone 72, unplugged as shown in FIG. 3, and removed. Rotating rod 30 and arms 34 and 36 in a reverse direction, as shown by the arrow, will permit the lower assembly of spring 76, shaft 74, cone 72, spool 38, and radial support arms 26 to be removed for cleaning. By connecting the bracket 56 to the stove top 11, reflector bowl 58 can also be removed to permit cleaning of it and the space below. The reassembly occurs in reverse order.

Figure 4:
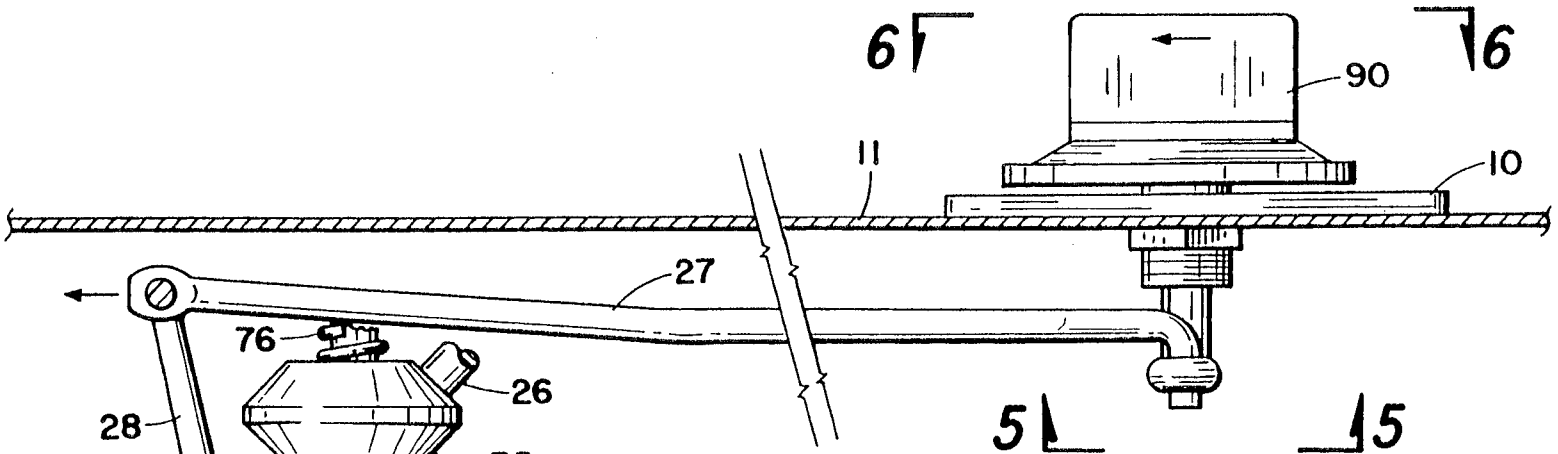
FIG. 4 is a partial elevational view taken along line 4—4 of FIG. 2.
Figure 6:
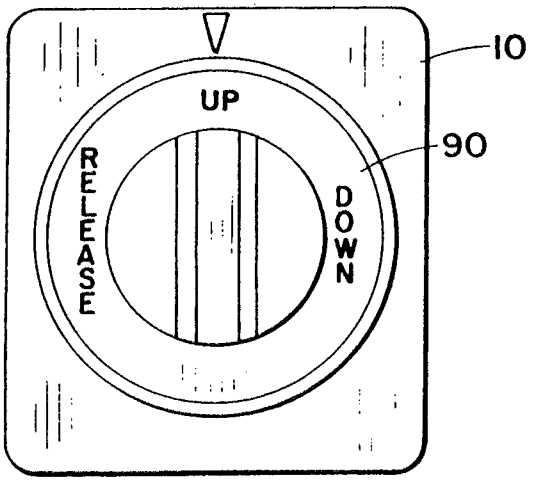
FIG. 6 is a front view of the control knob taken along the line 6—6 of FIG. 4.
Figure 5:
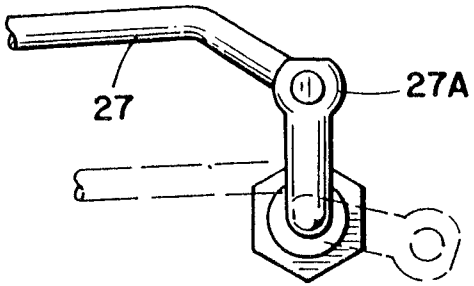
FIG. 5 is a view taken along the line 5—5 of FIG. 4.

The embodiment of FIGS. 4–6 is changed only by the use of a rotatable knob 90 to control use and disassembly of the burner assembly.

Figure 8:
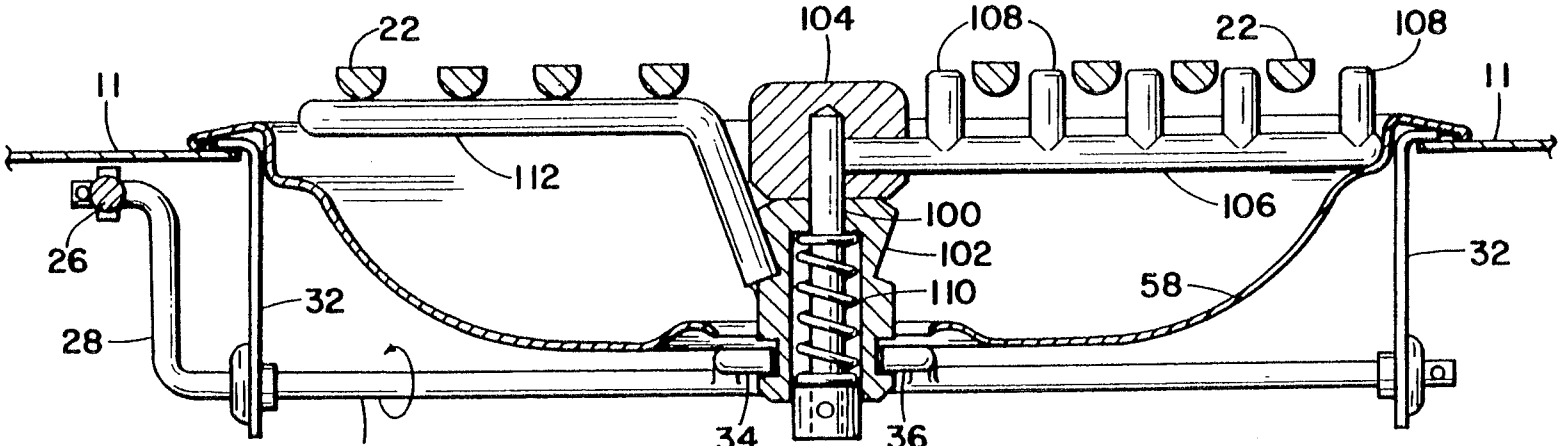
FIGS. 8 and 9 are sectional views of an alternate construction of the burner elements of this invention.
Figure 9:
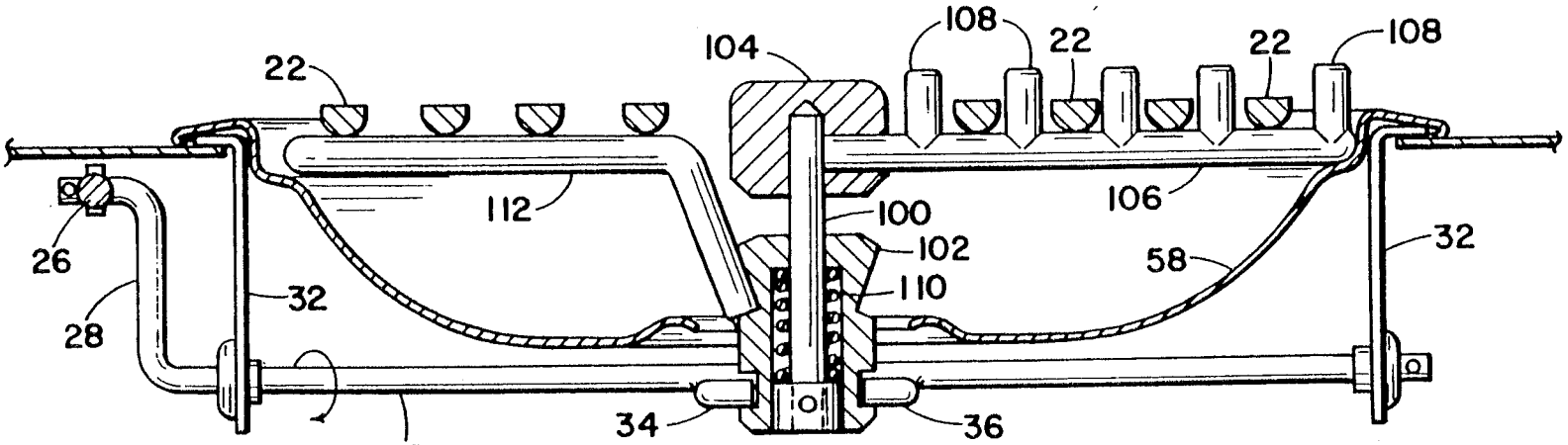

FIGS. 8 and 9 describe an alternate raise/lower assembly. Like numerals for like parts as shown in the previous figures are used. A vertically member 100, which is supported from the electric range, extends through a hollow spool 102 to support to a central hub 104 which contains plurality of radial arms 106 having cookware support posts 108. A spring 110 is coiled around the vertical member 100 and held inside spool 102. When burner element 22 and its radial support arms 112 are in the raised position, spring 110 exerts pressure forcing spool 102 to its highest point. When spool 102 is at its highest point, so are the burner support arms 112 and the burner element 22. FIG. 9 describes the embodiment of FIG. 8 depicting the heating elements 22 and the supporting radial arms 112 in the lower position below the tops of support posts 108. This occurs by the rotation of the shaft 30 in the directions shown which lowers the spool 102 and the connected arms 112 and heating element 22.

WHAT IS CLAIMED:

1. A surface heating unit for an electric range comprising:

a reflective bowl with a central bottom opening above which is situated an electrical heating element arranged in a horizontal circular or helically arranged pattern;

means to removably connect said heating element to an electrical connection means through a side opening in said reflective bowl, said means comprising a retainer means for a female electrical plug to receive a male plug formed as a part of said heating element, means to support said retainer to said stove whereby said retainer can move vertically upward and downward;

a plurality of radial arms connected to a central hub, said heating element connected to a top side of said radial arms;

a spool assembly co-axially positioned below and removable connected to said central hub;

a plurality of horizontal members radially attached to said spool assembly, said horizontal members normally resting upon a peripheral edge of said reflector bowl, a plurality of vertical cookware support posts attached to and extending above said horizontal members between said heating element;

means to bias said central hub axially such that a top of said heating element is normally in a raised horizontal position above said vertical cookware support posts, said means comprising a co-axial compression spring between said central hub and said spool assembly;

a coaxial vertical member extending upward through said central bottom opening of said reflective bowl and connected to said spool assembly through said spring; and a follower means attached to said vertical member below said spool assembly; said spool assembly;

an actuating arm and cam means to releasably interconnect with said follower means;

means, during use of said surface heating unit, to rotate said actuating arm and cam means downward to cause said coaxial vertical member and said heating element to move axially downward to a lower horizontal position below a top of said vertical cookware support posts and said means, before or after said use, to rotate said cam means upward from contact with said follower means such that when said heating element and said attached radial arms are removed, said spool assembly and said reflector bowl can be removed from the said electric range.

2. The unit of claim 1 wherein said retainer includes means, adjacent to said side opening to guide said male plug during removal or in connecting with said female electrical plug.

3. The unit of claim 2 wherein said means to guide comprise vertical side members extending from said side opening to said female electrical plug.

4. The unit of claim 1 wherein said means to support said retainer includes a bracket affixed to said stove, a pair of vertical arms extending downward therefrom to receive circular guides formed as a part of said retainer means, and a stop means to limit downward movement of said retainer means.

5. The unit of claim 1 wherein said removable connection comprises an interior surface in said central hub which is removably situated upon a substantially matching exterior surface connected to said coaxial vertical member.

6. The unit of claim 5 wherein said interior and exterior surfaces are conical.

7. The unit of claim 5 wherein said interior and exterior surfaces are cylindrical.

8. The unit of claim wherein said removable connection includes an interior surface of said central hub removably connectable with a plural stepped exterior surface connected to said co-axial vertical member.

9. The unit of claim 8 wherein said exterior surface is conical.

10. The unit of claim 8 wherein said exterior surface is cylindrical.

11. The unit of claim 1 wherein said electric range includes a control panel and said means to rotate comprises a control knob attached to a first end of said actuating arm, said control knob extending through said control panel with means to move said knob between said raised position and said lower position.

12. The unit of claim 1 wherein said electric range includes a control panel, and said means to rotate comprises an electric solenoid means controlled by a control knob situated at said control panel.

13. A surface heating unit for an electric range comprising:

a reflective bowl with a central bottom opening above which is situated an electrical heating element arranged in a horizontal circular or helically arranged pattern;

means to removably connect said heating element to an electrical connection means through said reflective bowl, said means comprising a retainer means for a female electrical plug to receive a male plug formed as a part of said heating element, means to support said retainer to said stove whereby said retainer can move vertically upward and downward;

a plurality of horizontal members radially attached to a central hub, said horizontal members normally resting upon a peripheral edge of said reflector bowl, a plurality of vertical cookware support posts attached to and extending above said horizontal members between said heating element;

a spool assembly co-axially positioned below and removably connected to said central hub;

a plurality of radial arms connected to said spool assembly, said heating element resting on a top side of said radial arms;

a vertical member extending upward and coaxial with said central bottom opening of said reflective bowl, thence through said spool assembly and through a spring means to a fixed connection with said central hub;

said spring means to normally bias said spool assembly axially such that said heating element is in a raised horizontal position above said vertical cookware support posts;

a follower means attached to said spool assembly;

an actuating arm and cam means to releasably interconnect means during use of said surface heating unit, to rotate said actuating arm and cam means downward to cause said co-axial vertical member and said heating element to move axially downward to a lower horizontal position below a top of said vertical cookware support posts and said means, before or after said use, to rotate said cam means upward from contact with said follower means whereby said heating element, said spool assembly, said central hub, and said reflector bowl can be removed from the said electric range.

14. The unit of claim 13 wherein said electric range includes a control panel and said means to isolate comprises a control knob attached to a first end of said actuating arm, said control knob extending through said control panel with means to move said knob between said raised position and said lower position.

15. The unit of claim 13 wherein said electric range includes a control panel, and said means to rotate comprises an electric solenoid means controlled by a control knob situated at said control panel.

* * * * *